US007283019B2

(12) United States Patent
Castiglione et al.

(10) Patent No.: US 7,283,019 B2
(45) Date of Patent: Oct. 16, 2007

(54) TUNEABLE PHASE SHIFTER AND/OR ATTENUATOR USING PHOTORESPONSIVE-MATERIAL IN A WAVEGUIDE

(75) Inventors: Dario Calogero Castiglione, Reading (GB); Luisa Deias, Cagliari (IT); Inigo Ederra-Urzainqui, Isaba (ES); David Brian Haskett, Limerick (IE); Derek Jenkins, Wantage (GB); Alexandre Vincent Samuel Bernard Laisne, Vains (FR); Alec John McCalden, Farncombe (GB); James Peter O'Neil, Sheffield (GB); Jorge Teniente-Vallinas, Lodosa (ES); Frank Van De Water, Waalre (NL); Alfred A. Zinn, Seeheim-Jugenheim (DE); Peter De Maagt, Katwijk (NL); Chris Mann, St Mawgan (GB)

(73) Assignee: Agence Spatiale Europeenne, Paris (FR)

( * ) Notice: Subject to any disclaimer, the term of this patent is extended or adjusted under 35 U.S.C. 154(b) by 2 days.

(21) Appl. No.: 10/532,737

(22) PCT Filed: Oct. 24, 2003

(86) PCT No.: PCT/EP03/13336

§ 371 (c)(1),
(2), (4) Date: Apr. 25, 2005

(87) PCT Pub. No.: WO2004/038849

PCT Pub. Date: May 6, 2004

(65) Prior Publication Data

US 2005/0270121 A1 Dec. 8, 2005

(30) Foreign Application Priority Data

Oct. 25, 2002 (GB) ..... 0224911.8

(51) Int. Cl.
*H01P 1/18* (2006.01)
*H01P 1/26* (2006.01)

(52) U.S. Cl. ..... 333/157; 333/81 R

(58) Field of Classification Search ..... 333/157, 333/81 B, 248
See application file for complete search history.

(56) References Cited

U.S. PATENT DOCUMENTS

| | | | |
|---|---|---|---|
| 2,856,589 A | 10/1958 | Kazan | |
| 4,263,570 A | 4/1981 | De Fonzo et al. | 333/157 |
| 5,099,214 A | 3/1992 | Rosen et al. | 333/157 |

OTHER PUBLICATIONS

G. Hadjicostas et al., "Optically Controlled Millimeter Wave Phase Shifter in a Metallic Wafeguide", IEEE MTT-S Digest, 1987, pp. 657-660 (XP-00268833).

V. Lubecke, et al., "Micromachining for Terahertz Applications", IEEE Transactions on Microwave Theory and Techniques, vol. 46, No. 11, Nov. 1998, pp. 1821-1831.

M. Yap, et al., "Silicon Macromachined Waveguides for Millimeter and Submillimeter Wavelengths", Symposium Proceedings: Third International Symposium on Space Terahertz Technology, Ann Arbor, Michigan, Mar. 1992, pp. 316-323.

*Primary Examiner*—Benny Lee
(74) *Attorney, Agent, or Firm*—Clark & Brody

(57) ABSTRACT

The invention relates to a tuneable phase shifter and/or attenuator comprising a waveguide having a channel and a piece of photo-responsive material (18) disposed within the waveguide along an internal wall of said channel, a light source disposed outside the waveguide to emit light through an aperture (30) of said internal wall to impinge on at least part of an outside surface of said piece of photo-responsive material (18).

16 Claims, 9 Drawing Sheets

13
14
10
20
18
21
12
17
16
15
11

13
14
20
26
12
18
17
16
15
11

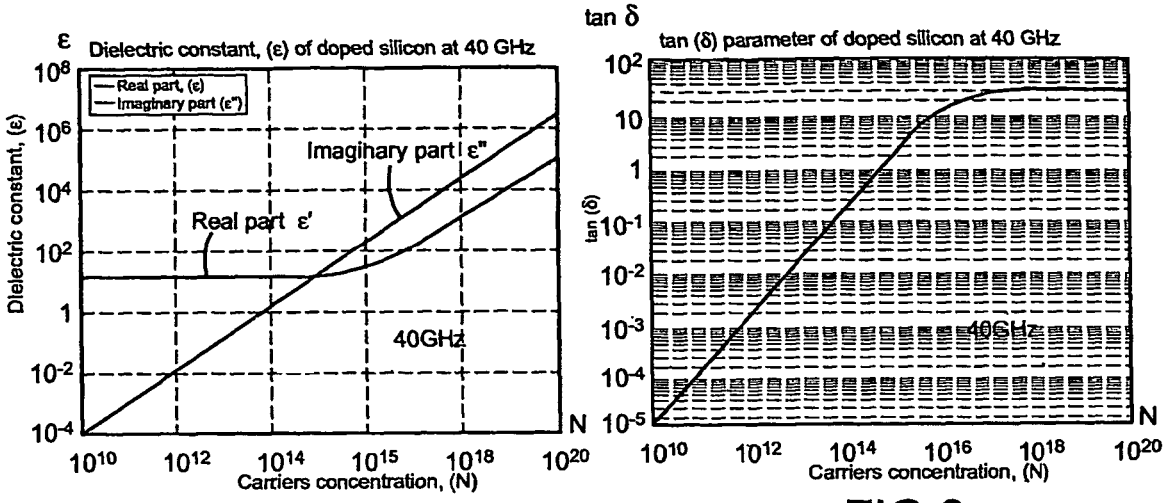
FIG.9
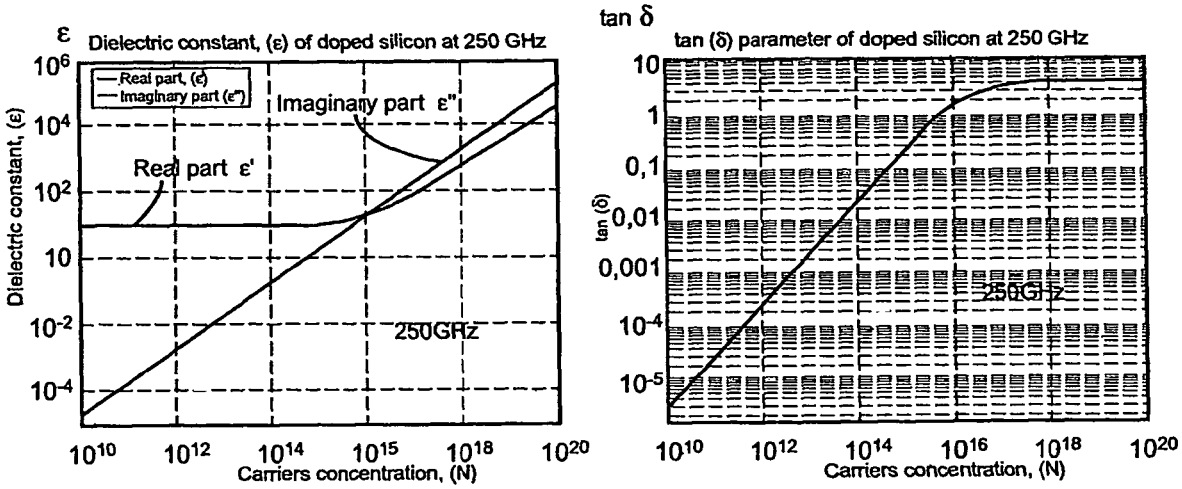
FIG.10
FIG.11
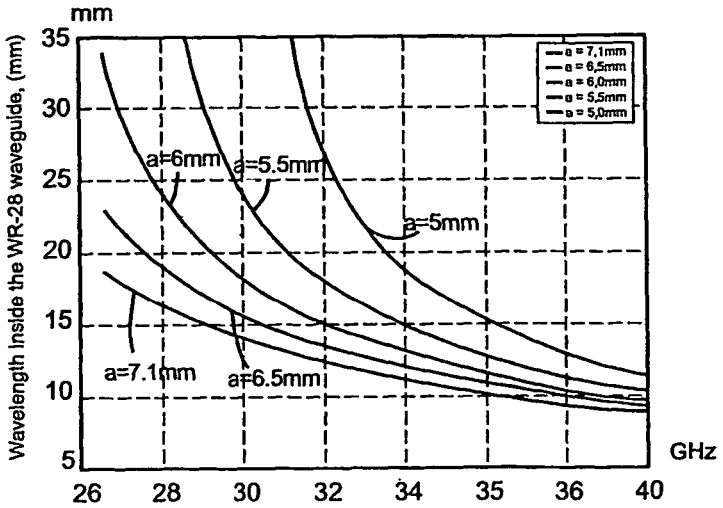

TUNEABLE PHASE SHIFTER AND/OR ATTENUATOR USING PHOTORESPONSIVE-MATERIAL IN A WAVEGUIDE

FIELD OF THE INVENTION

The present invention relates to a phase shifter and/or attenuator and in particular to an optically tuneable phase shifter and/or attenuator capable of operating in the microwave, millimeter and sub-millimeter wave spectrum. The phase shifter and/or amplitude attenuator may be used in a wide range of applications including, but not limited to, phase-shift-keying circuitry, terahertz imaging, transceivers and phased-array antennas.

BACKGROUND ART

As far as the sub-millimeter range is concerned, terahertz technology been primarily been used in the fields of terrestrial astronomy and earth observation. However, many materials that are opaque in the optical and infrared regions are transparent to terahertz waves (0.1 THz to 10 THz). Applications for terahertz technology have thus recently expanded to include areas such as aerial navigation where terahertz waves are able to penetrate clouds and fog, medical imaging where body tissue can be examined without using potentially harmful ionizing radiation, and non-invasive security systems for use at airports and ports in which the terahertz waves are able to pass through clothing and materials normally opaque to infrared.

Due to the sub-millimeter wavelengths of terahertz waves, the required dimensions and accuracy of components such as antennas, waveguides, lenses, mirrors etc. make fabrication difficult and costly using conventional manufacturing techniques.

In the millimeter waveband, ferroelectric phase shifters are often employed in which the phase of the signal is shifted by varying the permittivity of the ferroelectric material by means of an applied electric field. However, ferroelectric phase shifters suffer from substantial power losses, signal distortions and noise, and offer only discrete steps.

An optically activated waveguide type phase shifter and/or attenuator has been disclosed in U.S. Pat. No. 5,099,214 (ROSEN et al.). This device comprises a semiconductor slab that is attached to an inside wall of a waveguide and which receives light from an illumination source disposed in an aperture of an inside wall opposite inside wall. In U.S. Pat. No. 4,263,570 (DE FONZO), a piece of semiconductor material is attached to an inside wall of a waveguide and an inside surface of said piece is lit from outside by a light source through an aperture in a wall opposite inside wall.

In these prior art documents, where illumination is from the opposite waveguide wall, a lossy resistive layer forms inside the waveguide at a distance from the inside wall that is equal to the thickness of the semiconductor piece or slab, which means that the insertion losses will be always high, and that a high level of light is necessary to obtain a significant phase shift or attenuation. Namely, this light level should be generally high enough to generate a high density of carriers to place the photo-sensitive material (Si) in a metallic or semi-metallic state.

It is therefore an object of the present invention to provide a tuneable phase shifter and/or attenuator capable of operating at microwave, millimetric and/or sub-millimetric wavelengths with an improved tuneability. According to the invention, this is obtained by a positioning of a light source and/or a photo-responsive material spaced relatively to the waveguide, and by providing a modification of the carrier concentration within a photo-responsive material by the illumination of light.

SUMMARY OF THE INVENTION

According to a first aspect, the present invention provides a tuneable phase shifter and/or attenuator comprising a waveguide having a channel and a photo-responsive material disposed within the waveguide along an internal wall of the channel, a light source disposed outside the wave guide to emit light through an aperture of the internal wall to impinge on at least part of an outside surface of the photo-responsive material. According to this first aspect, the phase is modified by changing the effective width of the waveguide, without changing the mode of propagation.

The photo-responsive material preferably has a high electrical resistivity. The surface of the photo-responsive material facing the aperture can be pacified, e.g. by oxidation.

The phase shifter may also include a plurality of metal strips which extend across the surface of the photo-responsive material facing the aperture. The purpose of this metallic grid is to avoid the internal wave travelling inside the waveguide being radiated outside it and also to allow light (smaller wavelength), to enter the waveguide. The size of the grid depends on the frequency of the radiation propagated by the waveguide.

In U.S. Pat. No. 5,099,214, it has been suggested that to space a slab off of a wall by a distance that may be such that the slab is centered along the waveguide width.

However, this positioning of the slab inside the waveguide and spaced from the wall is even less favourable relative to insertion losses. The inventors have identified that there is another phenomenon rather than one that changes the effective waveguide width through the creation of a quasi metallic state in the semiconductor. The other phenomenon is varying the imaginary part of the dielectric constant of the semiconductor by illumination so that other waveguide modes that would not normally be present are able to propagate.

According to a second aspect, the present invention provides a tuneable phase shifter and/or attenuator comprising a waveguide having a channel and a piece of photo-responsive material disposed within the waveguide and spaced from an internal wall of the channel, and a light source to emit light to impinge on at least part of a surface of the photo-responsive material, the light source being adjustable in intensity and/or illumination length to generate in the photo-responsive material a carrier concentration between $10^{12}$ $cm^{-3}$ and $10^{16}$ $cm^{-3}$, to modify the real and imaginary part of the dielectric constant of the photo-responsive material to generate at least one mode that has part of its field inside the photo-responsive material layer and part of its field in the waveguide whereby a phase shifter and/or attenuator that is dependant on the light illumination (in intensity and/or length) is generated over a frequency range.

The phase light is obtained by changing the mode of propagation. Moving the semiconductor layer away from the waveguide wall, allows higher order modes to propagate over the frequency range and these have greatly different effective guide wavelengths and phases.

The photo-responsive material may be photo-conductive material such as a semiconductor for example Si, GaAs or Ge, whether intrinsic or doped.

BRIEF DESCRIPTION OF THE DRAWINGS

Embodiments of the present invention will now be described by way of example with reference to the accompanying drawings, in which:

FIGS. 9 and 10 show the dielectric constant and tan $\delta$ of Si respectively at 40 GHz and 250 Hz.

FIG. 11 shows the wavelength (in millimeters) inside a WR-28 waveguide versus frequency in the Ka band and versus a change in the parameter a.

DESCRIPTION OF THE PREFERRED EMBODIMENTS

Figure 1:
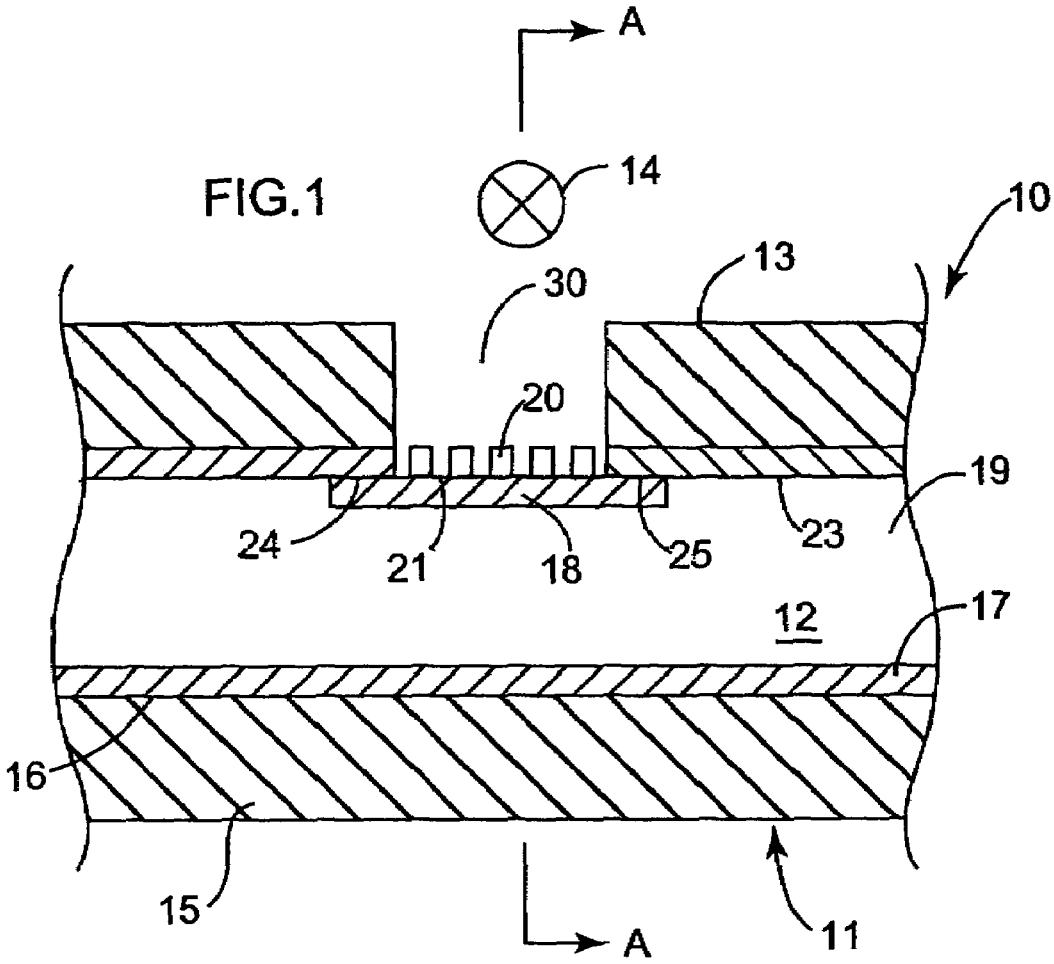
FIG. 1 is a schematic cross-sectional view of a tuneable phase shifter or tuneable attenuator in waveguide technology in accordance with the present invention.
Figure 2:
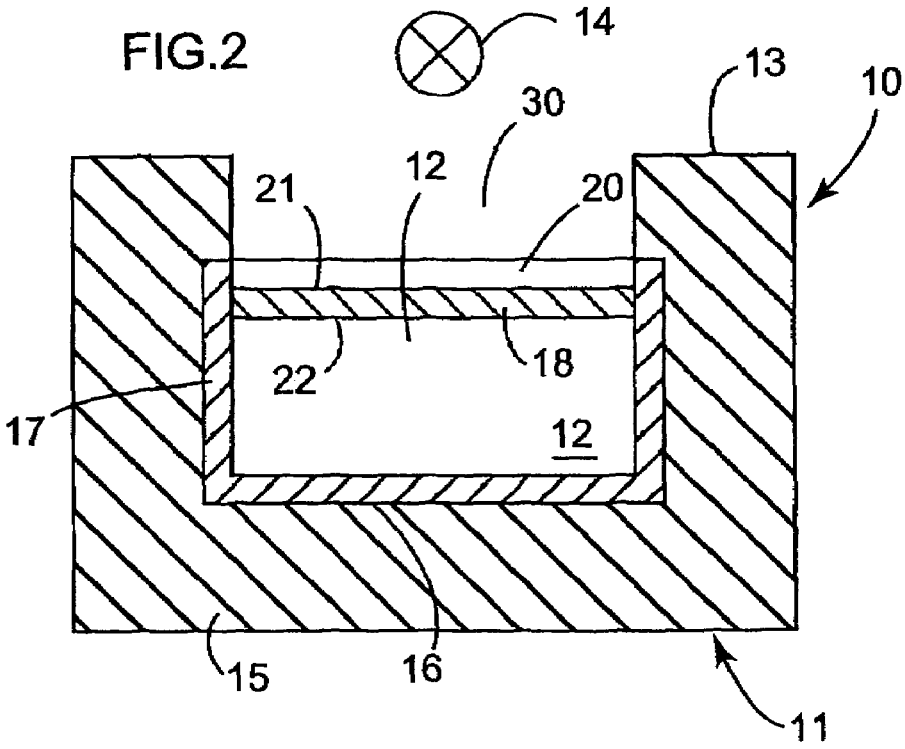
FIG. 2 is a schematic cross-sectional view of a tuneable phase shifter or tuneable attenuator in waveguide technology in accordance with the present invention taken along the line A-A in FIG. 1.

The tuneable phase shifter 10 illustrated in FIGS. 1 and 2 comprises a waveguide 11 having a central channel 12 which extends the length of the waveguide 11 and an aperture formed in a side 13 of the waveguide 11. The tuneable phase shifter 10 may further comprise a metallic grid 20 to avoid radiation of the microwave, mm-wave or submm-wave inside the waveguide to be lost outside the waveguide system.

A photo-responsive layer 18 is disposed within the channel 12 of the waveguide 11 so as to extend substantially across the aperture. An adjustable irradiation source of light 14 emits light at a certain part of the spectra where the photo responsive material inside the waveguide absorbs it better (infrared, visible, ultraviolet . . . ). Source of light 14 is located outside the waveguide such that irradiating radiation from the source 14 is incident upon an area of the photo-responsive layer 18 exposed by the aperture 30 formed in a side 13 of the waveguide 11. The photoconductive material is placed directly against the waveguide wall and is illuminated through the wall against it is placed. If the intensity of light is sufficient, a quasi-metallic layer (described below) is formed at the waveguide wall/photo-responsive material boundary which is closest to the waveguide wall. This layer changes the effective width of the waveguide which results in a change in effective guide wavelength and hence phase. As the thickness of the quasi-metallic layer 26 is depended on the light intensity, so is the phase shift.

The photo-responsive layer 18 may be of semiconductive material, e.g. Si, AsGa, Ge.

The waveguide 11 comprises a silicon or metallic body 15 having a central channel 12 substantially rectangular in cross-section extending the length of the silicon body 15. The width and height of the channel 12 may be as is conventionally employed in rectangular waveguide construction. However, the dimensions of the silicon body 15 may be adjusted according to preference.

The inner surfaces 16 of the silicon body 15 may be coated with a metallic film 17, preferably using for example vacuum deposition and electroplating techniques. Suitable metals for coating the silicon body 15 include, but are not limited to, nickel, copper, brass, chromium, silver and gold. The metal coating 17 acts to reflect radiation propagating along the length of the channel 12. Accordingly, the coating 17 may comprise any material which serves to reflect radiation.

Alternatively, a completely metallic waveguide made for example by a milling machine may be used.

A construction of metallized silicon waveguides for terahertz applications using micromachining techniques is known and is described for example in "Silicon Micromachined Waveguides for Millimeter and Submillimeter Wavelengths", Yap et al., Symposium Proceedings: Third International Symposium on Space Terahertz Technology, Ann Arbor, Mich., pp. 316-323, March 1992 and "Micromachining for Terahertz Applications", Lubecke et al., IEEE Trans. Microwave Theory Tech., Vol. 46, pp. 1821-1831, Nov. 1998.

The aperture formed in the side 13 of the waveguide 11 extends through the silicon body 15 and the metal coating 17 on one of the longer sides of the waveguide 11. The aperture may be rectangular in shape and with a width substantially similar to the width of the channel 12. The length of the aperture is characterised by the desired degree of phase shifting at the frequency of operation. Generally speaking, the longer the length of the aperture (or rather the longer the exposed region of the photo-responsive reflector 18), the greater the degree of phase shifting and/or attenuation.

The semi-conductor layer 18 may be associated with a plurality of reflective elements 20. The layer of photo-responsive semi-conductor layer 18 has for example an upper surface 21 and lower surface 22 (see FIG. 2) substantially rectangular in shape. The width of the layer 18 may be substantially similar to the width of the channel 12, while the length of the layer 18 is preferably longer than the length of the aperture formed on the side 13 of the waveguide 11. Preferably the length of the layer 18 is only slightly longer than that of the aperture. The layer 18 is secured within the channel 12 of the waveguide 11 such that the layer 18 extends substantially across the aperture formed in the side 13 of the waveguide 11. The layer of photo-responsive material 18 is secured to a wall 23 of the channel 12 for example by a thin layer of adhesive applied at the ends 24, 25, see FIG. 1, of the layer 18 extending beyond the length of the aperture. Alternatively, if the waveguide is made of metallized silicon, layer 18 may be integral with the waveguide.

The photo-responsive material 18 may be photo-conductive preferably consists substantially of intrinsic silicon. However, alternative photo-responsive materials which may be used include, but are not limited to, GaAs and Ge.

When the optical radiation is incident upon the exposed surface 21 of the photo-responsive layer 18, photo-excited carriers are created at a region near the surface 21. Accordingly, the dielectric constant of the photo-responsive material 18 in this region changes; generally referred to as photo-induced reflectivity. The reflectivity of the irradiated surface 21 of the photo-responsive material 18 can even be rendered similar to that of a metal in dependence upon the intensity of the incident optical radiation, but with this device it is sufficient to have a small increase of the real part of the dielectric constant associated with a large increase of the imaginary part of the dielectric constant. At this point, the photo-responsive material 18 can be regarded as having a separate photo-induced resistive layer (reference numeral 26 in FIG. 4), but for a thin layer, the effect of the light is to change the dielectric properties of the material in depth, i.e. essentially the imaginary part of the dielectric constant in all the thickness.

While the photo-responsive material 18 is generally transparent to the radiation propagating along the channel 12 of the waveguide 11, some power loss of the signal will occur. Accordingly, the thickness of the layer of photo-responsive material 18 may be for example between 60 and 100 μm. A higher thickness up to about 1000 μm may be used. Moreover, the photo-responsive material 18 is preferably silicon.

The lifetime of the photo-excited carriers are determined primarily by their mobility and the availability of recombination sites in the lattice of the photo-responsive material 18. By increasing the lifetime of the carriers, the lifetime of the photo-induced reflective layer can be extended. Accordingly, the irradiation delivered by the source 14 may be delivered over shorter periods of time. Not only does this reduce the amount of power consumed by the irradiation source but it also prevents the photo-responsive material 18 from reaching potentially damaging temperatures which can arise from continuous irradiation. In order to increase the lifetime of the carriers, the photo-responsive layer 18 preferably has a high electrical resistivity (>1 $k\Omega cm^{-2}$). The photo-responsive layer 18 may consist of silicon having an electrical resistivity for example between 4 and 10 $k\Omega cm^{-2}$.

Moreover, the lifetime of the carriers can be further increased for example by pacifying the irradiated surface 21 of the photo-responsive material 19, see FIG. 1. The surface 21 of the photo-responsive layer 18 offers a large number of recombination sites. By pacifying the irradiated surface 21, the number of recombination sites available to the carriers is significantly reduced. The uppermost surface 21 of the photo-responsive material is therefore preferably oxidized. Even with oxidation, however, the number of recombination sites remains sufficiently high to significantly affect the mobility of carriers. It has been found, however, that applying a coating of an adhesive such as an epoxy resin to the oxidized surface of the photo-responsive material can significantly increase carrier lifetime.

In having a photo-responsive layer 18 comprising essentially of high resistance silicon for example with a resistivity of between 4 and 10 $k\Omega cm^{-2}$ and an oxidized upper surface coated in an epoxy resin, the lifetime of the photo-induced carriers and thus the photo-induced reflective layer is substantially increased.

Accordingly, phase shifting may be achieved and maintained with relatively low intensity irradiation. However, in extending the lifetime of the photo-induced carriers, the response time of the phase shifter is increased.

It will, however, be appreciated that fast response times can be achieved by having a photo-responsive material in which the lifetime of the photo-induced carriers is relatively short. This may be achieved, for example, by having a photo-responsive layer of low resistance and whose surfaces have not been pacified.

The plurality of reflective elements 20 are formed on the uppermost surface 21 of the photo-responsive material 18 in the region defined by the aperture on the side 13 of the waveguide 11. The reflective elements 20 are preferably strips of reflecting material. Accordingly, the reflective elements 20 are strips of metal, that may be arranged as a grid. they allow that most part of light entering the photoresponsive material. Again, suitable metals include, but are not limited to, nickel, copper, brass, chromium, silver and gold. The strips are preferably aligned on the surface 21 of the photo-responsive material 18 so as to extend substantially parallel to the width of the channel 12 and thus perpendicular to the length of the channel 12. The length of the strips may be at least the width of the channel 12 and preferably extend across the full width of the photo-responsive material 18. The strips are evenly spaced (or tapered) along the length of the photo-responsive material 18 and cover preferably less than 50% of the region of the surface 21 revealed by the aperture 30. The width and separation of the strips is preferably no greater than 1 mm (this of course depends on frequency of operation). The strips should be of a thickness suitable for total reflection of incident radiation without any substantial loss. The strips may be applied, for example, by applying a mask to the surface 21 of the photo-responsive material 19 and depositing a metal film using vapour deposition.

The irradiation source 14 may be any source capable of generating photo-induced carriers reflectivity in the layer 18 of photo-responsive material and is preferably a commercially-available laser or LED array having a visible or near-infrared wavelength, (in fact having the best frequency spectra for absorption by the photo responsive material used). The power required of the source 14 will depend upon, among other things, the type of photo-responsive material 18 and the degree of phase shifting or attenuation required.

An electronic circuit can control the degree of phase shifting or attenuation by means of the illumination of the photoresponsive material.

Figure 3:
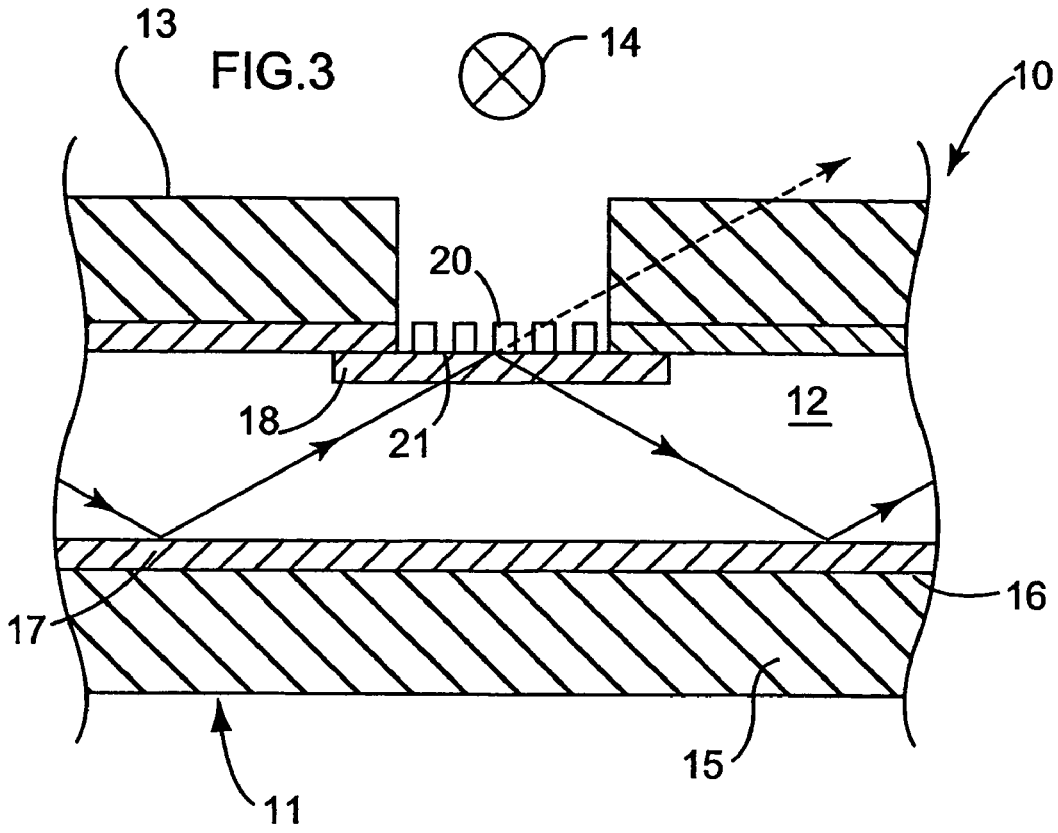
FIG. 3 is a schematic cross-sectional view of radiation propagating through a tuneable phase shifter or tuneable attenuator in waveguide technology in accordance with the present invention.
Figure 4:
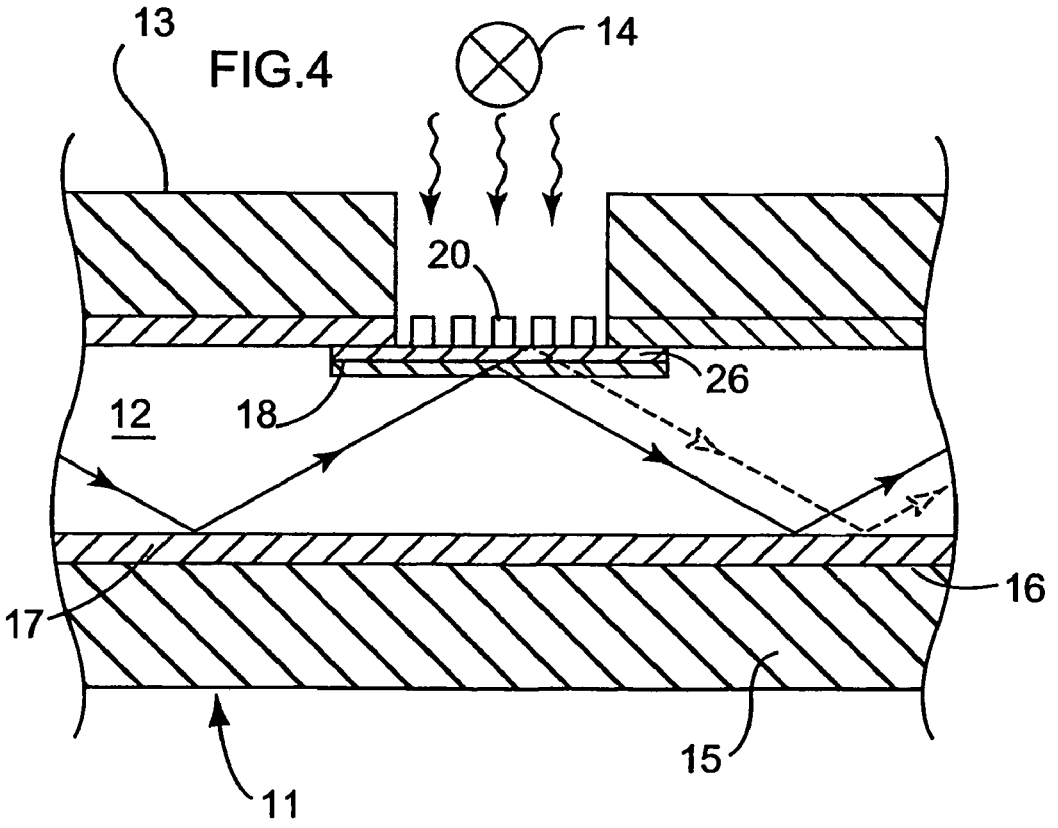
FIG. 4 is a further schematic cross-sectional view of radiation propagating through a tuneable phase shifter or tuneable attenuator in waveguide technology in accordance with the present invention.

Referring now to FIGS. 3 and 4 that show the aperture in the side 13 of the silicon body 15 and the inner surface 16, all part of the waveguide 10 (FIG. 3), and source of light 14, radiation propagating along the length of the channel 12 of the waveguide 11 is reflected internally by the surfaces of the metal coating 17. When the radiation is incident upon the photo-responsive material 18, the radiation propagates a little inside it due to its reduced dielectric constant. Upon reaching the uppermost surface 21 (FIG. 3) of the layer of photo-responsive material 18, a proportion of the radiation is reflected back towards the channel 12 by the plurality of reflective elements 20. A small fraction of the radiation is transmitted into the air (indicated by a broken line) and thus exits the waveguide 11. Due to the angle of incidence of the propagating radiation with respect to the photo-responsive material 18, no internal reflection occurs within the photo-responsive material 18. Accordingly, the radiation reflected by the reflective elements 20 propagates back through the photo-responsive material 18 and into the channel 12. The propagating radiation may be incident upon the photo-responsive material 18 more than once, according to the length of the reflector 18, before it continues propagating along with length of the channel 12 of the waveguide 11.

FIG. 4 illustrates the situation whereupon irradiating radiation delivered by the irradiation source 14 is incident upon the photo-responsive reflector 18. The irradiating radiation generates carriers in the photo-sensitive material and causes a photo-induced resistivity in photo-responsive material 18. The effective thickness or depth of the photo-induced resistive layer 26 will depend upon the wavelength and intensity of the irradiating radiation incident upon the photo-responsive material 18. When the radiation propagating along the channel 12 of the waveguide 11 is incident upon the photo-responsive layer 18, the radiation propagates through the photo-responsive material 18 only so far as the photo-induced reflective layer 26. Upon reaching the photo-induced resistive layer 26, the propagating radiation is reflected back towards the channel 12.

The photo-induced lossy material in layer 18 changes the modal propagation in the waveguide so that no field will enter the lossy photoilluminated material but the change in the fundamental mode of that new waveguide will effectively change the phase. The propagating radiation now has a phase (or amplitude) that is substantially different to radiation propagating along the waveguide 11 in the absence of the photo-sensitive layer 18. Furthermore, phase shifting will occur every time the propagating radiation is incident upon the photo-responsive layer 18. Accordingly, the length of the photo-responsive layer 18 that is illuminated will also determine the degree of phase shifting. This illumination length may be adjustable to adjust phase shift and/or attenuation. As the changes in the modal propagation in the waveguide are determined by the intensity and wavelength characteristics of the irradiating radiation, the degree of phase shifting can accordingly be controlled by varying the intensity and/or wavelength of the irradiating radiation delivered by the source 14.

In the device shown in FIGS. 1 to 4, the silicon is illuminated on its face adjacent to the waveguide wall. This is important as the electric field in a rectangular waveguide with a semi-conductor inside (placed close to the wall or slightly spaced therefrom) is highest in the middle of the guide and zero at the edge, therefore a lossy material placed further towards the centre of the waveguide will absorb more energy than if it were placed at the edge. For a phase shifter the most desirable features is low insertion loss and large phase shift for small power requirement. When the phase shifter is illuminated at low light levels photo carriers are generated changing the resistivity of the material, however, also the imaginary part of the dielectric constant is varied. As the light intensity is increased eventually the silicon takes on metallic properties. In order to achieve a "quasi metallic layer" within the silicon there must be a high density of carriers $10^{18}$-$10^{21}$ carriers/cm$^3$. It is important to note, however, that this quasi metallic state is not an abrupt change from high resistivity to low resistivity but one that varies exponentially between the each extreme. On one side of the region (the one that is illuminated) there is a nearly metal state, the other has a high resistivity state and in between a lossy resistive state. It is this region within the silicon that causes the majority of the insertion loss. This lossy layer will always be on the opposite side of the quasi metal state region than the side thereof that is being illuminated as the light is decaying exponentially throughout the thickness of the silicon. When as in the present invention, the silicon layer adjacent the waveguide wall is illuminated from the outside, it starts to form first at the outside of the waveguide, hence the insertion loss is kept to a minimum. At lower light intensity, the lossy resistive region will be also at the outside of the material 18. In the prior art patents (U.S. Pat. No. 4,263,570 and U.S. Pat. No. 5,099,214) where illumination is from the opposite waveguide wall, the lossy layer forms first inside the waveguide at a distance from the waveguide wall that is equal to the thickness of silicon material 18. This is a fundamental difference and will mean that the insertion loss will always be higher. In addition, this position is fixed physically with respect to the waveguide wall. This means that the any resistivity variation within the silicon will occur between the innermost edge of the silicon and the waveguide wall. Consequently it will have a relatively small effect with respect to changing the effective width of the waveguide. With an illumination from the outside as in the present device, the opposite is true.

The dimensions of the channel 12 of the waveguide 11, the size and characteristics of the photo-responsive reflector 18 and the size of the aperture formed on the side 13 of the waveguide 11 may all be tailored to suit the desired performance of the phase shifter 10. An example of the dimensions that might be used for phase shifting terahertz frequencies is now described. The width and height of the channel 12 is preferably around 1.5 mm and 0.75 mm respectively. This provides a waveguide cut-off frequency of around 0.1 THz. Accordingly, the silicon wafer used to construct the silicon body 15 has a thickness of around 0.75 mm. The metal coating 17 is preferably of the order of 500 nm. The width of the aperture 30 formed on the side 13 of the waveguide is also preferably 0.75 mm. The length of the aperture 30 is preferably around 2 cm. The layer of photo-responsive material 19 preferably has a width, length and thickness of around 0.75 mm, 2.5 cm and 70 μm respectively and has an oxidation layer on the uppermost surface 21 typically or around 10-50 nm. Each reflecting element preferably has a width, length and thickness of around 0.5 mm, 0.75 mm and 500 nm respectively. The spacing between reflecting elements is preferably 0.5 mm.

While the embodiment described above comprises a waveguide having a single aperture and a single photo-responsive layer 18 extending across the aperture, it will be appreciated that two apertures may be formed on opposing sides of the waveguide 11. Two or more photo-responsive layers would then be employed and the degree of phase shifting or attenuation achievable may be doubled, tripled or quadrupled. It will be appreciated that the same technical effect might be achieved by doubling the length of the single aperture and photo-responsive reflector 18. Nevertheless, a phase shifter comprising two or more apertures and two or more photo-responsive layers 18 might be considered when the size, and in particular the length, of the phase shifter is a serious consideration.

It will be appreciated that the plurality of reflecting elements 20 may be omitted. In this situation, some form of irradiating radiation must be delivered to the photo-responsive reflector 18 such that a photo-induced reflective layer 26 is continuously present. For example, the irradiation source 14 may continuously irradiate the photo-responsive reflector 18 with radiation. Alternatively, the irradiation source 14 may deliver pulsed, high intensity irradiation.

Rather than forming a plurality of reflective elements 20 on the surface 21 of the photo-responsive material 18 facing the aperture, the reflective elements 20 could be formed on a separate element such as a glass plate. The glass plate could then be placed within the aperture so as to rest on top of the photo-responsive material 18.

The phase shifter 10 may also comprise an attenuator, such as a variable optical attenuator, to compensate for variations in the amplitude of the propagating radiation with phase shift, or a simple tuneable attenuator, not necessarily adjoining to the phase shifting device. Moreover, both phase and amplitude modulation of a signal is then possible.

Signals at millimeter wavelengths require a waveguide having larger dimensions than that for terahertz (sub-millimeter) frequencies. Accordingly, the degree of possible phase shifting is reduced owing to the reduced ratio of the photo-induced layer thickness with respect to the waveguide height. However, this reduction in phase shifting can be compensated by having a photo-responsive reflector 18 which is greater in length.

As the photo-responsive material 18 is generally transparent to the propagating signal, signal distortion and power loss is generally low in comparison to ferroelectric phase shifters.

The following relates to the advantage obtained for a phase shifter from the optical properties of silicon which, as been identified by the inventors, allows a change in the complex relative permittivity of the silicon as it is illuminated by a source of light in infrared wavelengths.

Illumination of silicon by means of a near-infrared/visible light source produces the generation of electron-hole pairs, thus producing plasma. This plasma is directly dependant on the intensity and wavelength of the incident light.

If we assume normal incidence of the light to the silicon wafer, the formulas that explain the properties of the material are as follows:

The amount of light reflected in an interface air-silicon is:

$$R_1 = \frac{(n_r - 1)^2 + n_i^2)}{(n_r + 1)^2 + n_i^2}$$

where $n=n_r+j\cdot n_i$ and n is the refraction index of the silicon.

Figure 5:
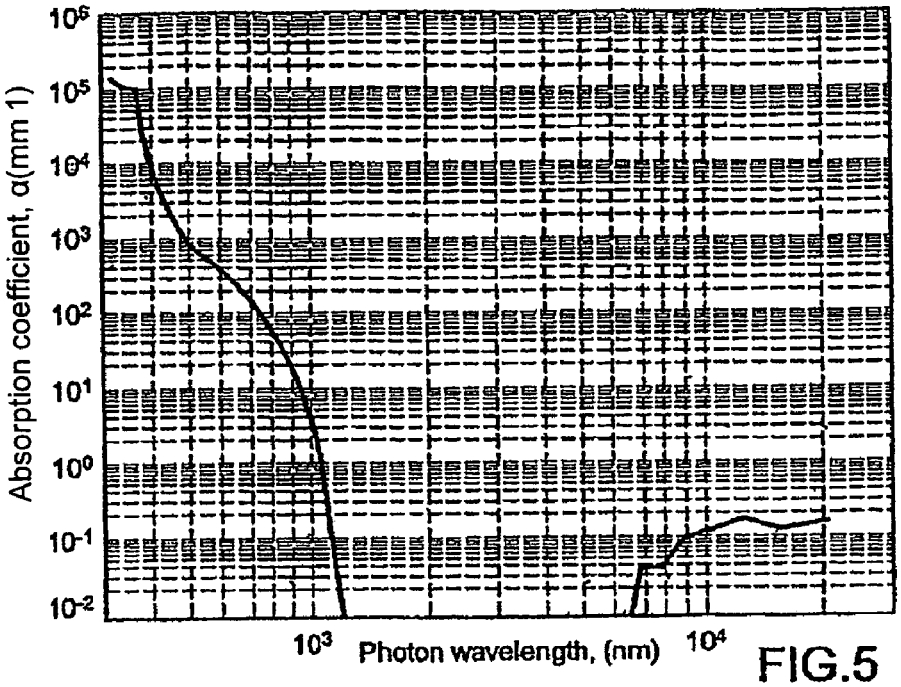
FIG. 5 illustrates the Absorption coefficient $\alpha$ of Si (in $mm^{-1}$) versus photon wavelength (in nanometers).

For absorption coefficient values greater than zero, the percentage R of total light reflected can be determined using the following equation:

$$R \approx R_1 + (1-R_1)\cdot R_1 \cdot e^{-\alpha\cdot 2\cdot t} - (1-R_1)\cdot R_1^2 \cdot e^{-\alpha\cdot 2\cdot t} + (1-R_1)\cdot R_1^3 \cdot e^{-\alpha\cdot 4\cdot t} - (1-R_1)\cdot R_1^4 \cdot e^{-\alpha\cdot 4\cdot t} + \ldots$$

where the $\alpha$ coefficient is the absorption coefficient of the silicon and it is dependant on the light wavelength, see FIG. 5. And t is the thickness of the silicon wafer.

Each term in the infinite series is associated with the successive reflections as the light bounces between the surfaces of the silicon wafer. Similarly, the percent transmission T can be determined using the following equation:

$$T \approx (1-R_1)\cdot e^{-\alpha\cdot t} - (1-R_1)\cdot R_1 \cdot e^{-\alpha\cdot t} + (1-R_1)\cdot R_1^2 \cdot e^{-\alpha\cdot 3\cdot t} - (1-R_1)\cdot R_1^3 \cdot e^{-\alpha\cdot 3\cdot t} + \ldots$$

where the percent absorbed light A is given by:

$$A \approx 1-(R+T)$$

There are essentially two regions of strong optical absorption in Silicon. FIG. 5 shows the absorption coefficient versus photon wavelength for the visible-FIR and IR regions respectively. For photon energies equal-to-or-greater-than the energy gap, normal optical absorption with the generation of free carriers occurs.

Figure 6:
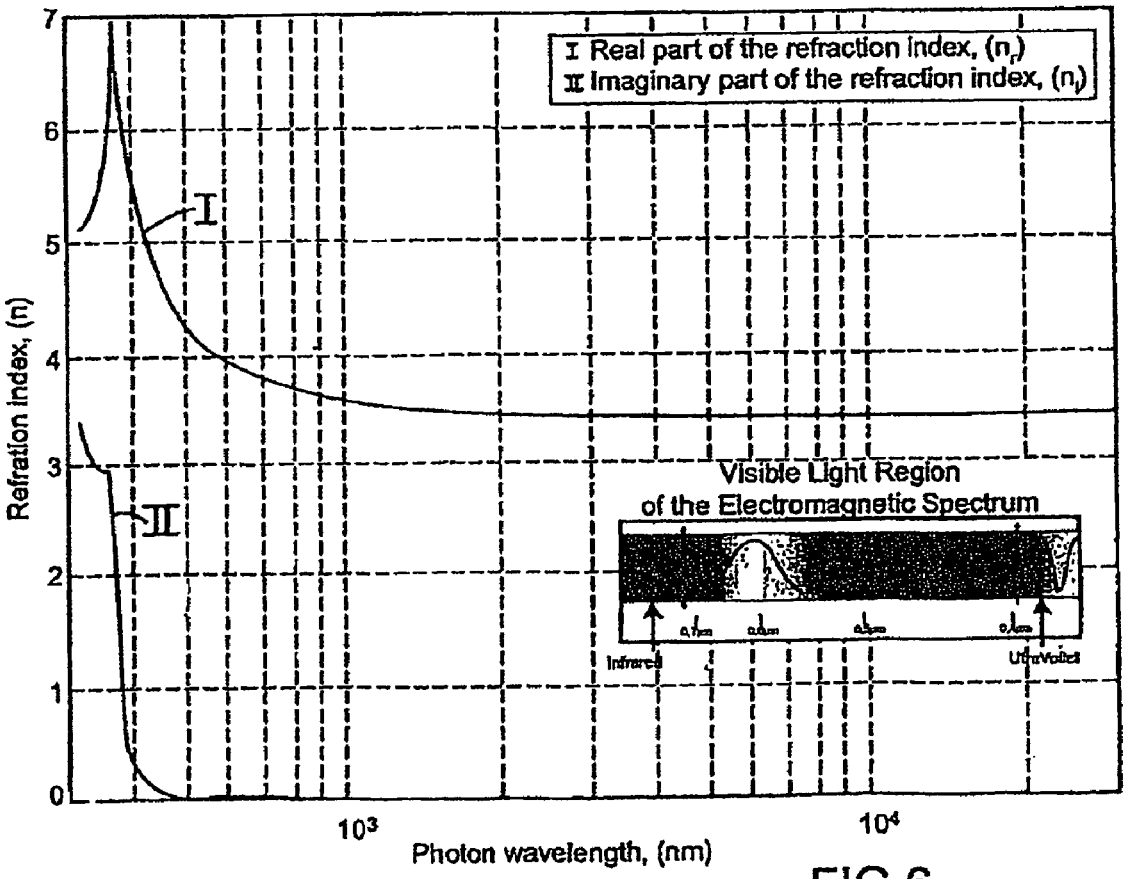
FIG. 6 illustrates the refraction index of Si versus photon wavelength in nanometers.

In FIG. 6, a plot of the refraction index of silicon material is depicted against wavelength (in nanometers) with curve I representing the real part of the refraction index $n_r$ and curve II representing the imaginary part of the refraction index $n_r$. The refraction index has its maximum at the violet color of the spectrum, this means that violet-blue light is reflected by silicon stronger than other visible colors so we see this material as violet-blue coloured.

Figure 7:
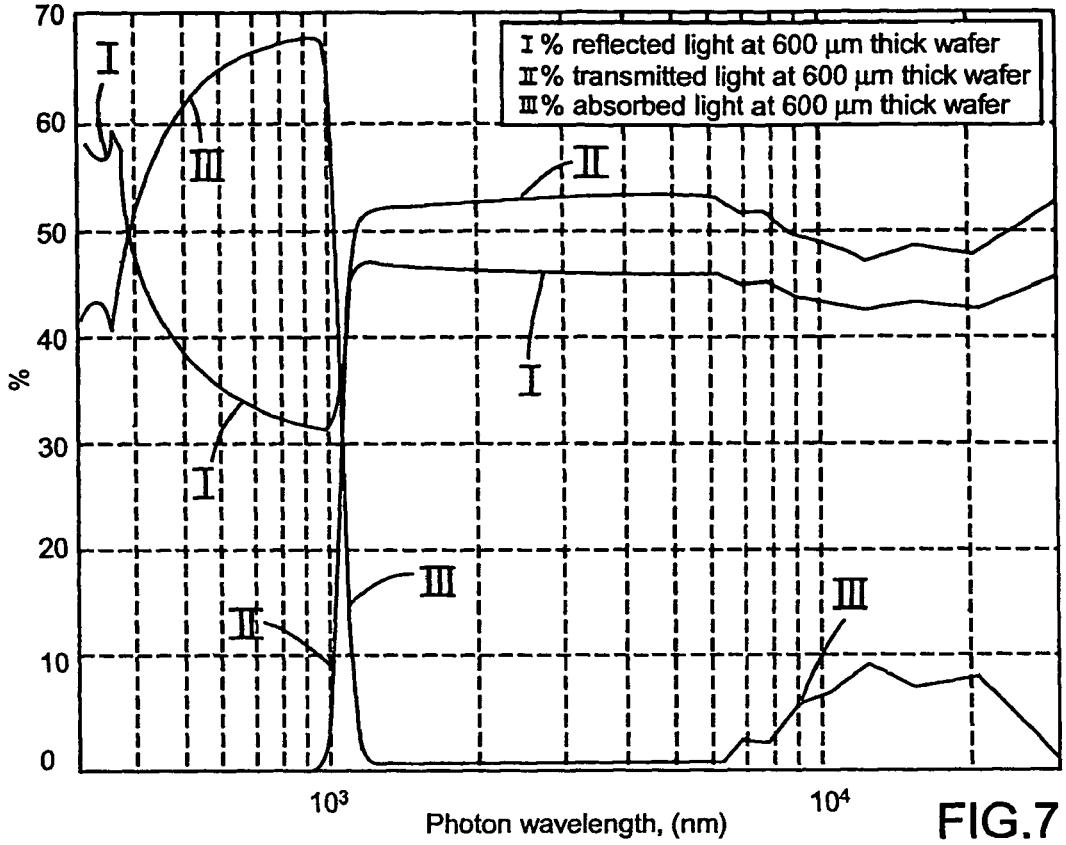
FIG. 7 illustrates the percentage of light reflected, transmitted and absorbed by Si versus photon wavelength in nanometers (curves I, II and III respectively)

In FIG. 7, we can see the amount of light power absorbed, reflected and transmitted by a silicon wafer of 600 μm thickness, with curve I indicating the percentage of reflected light, curve II indicating the percentage of transmitted light, and curve III indicating the percentage of absorbed light. The maximum absorption occurs for red color visible light and near infrared wavelengths.

Figure 8:
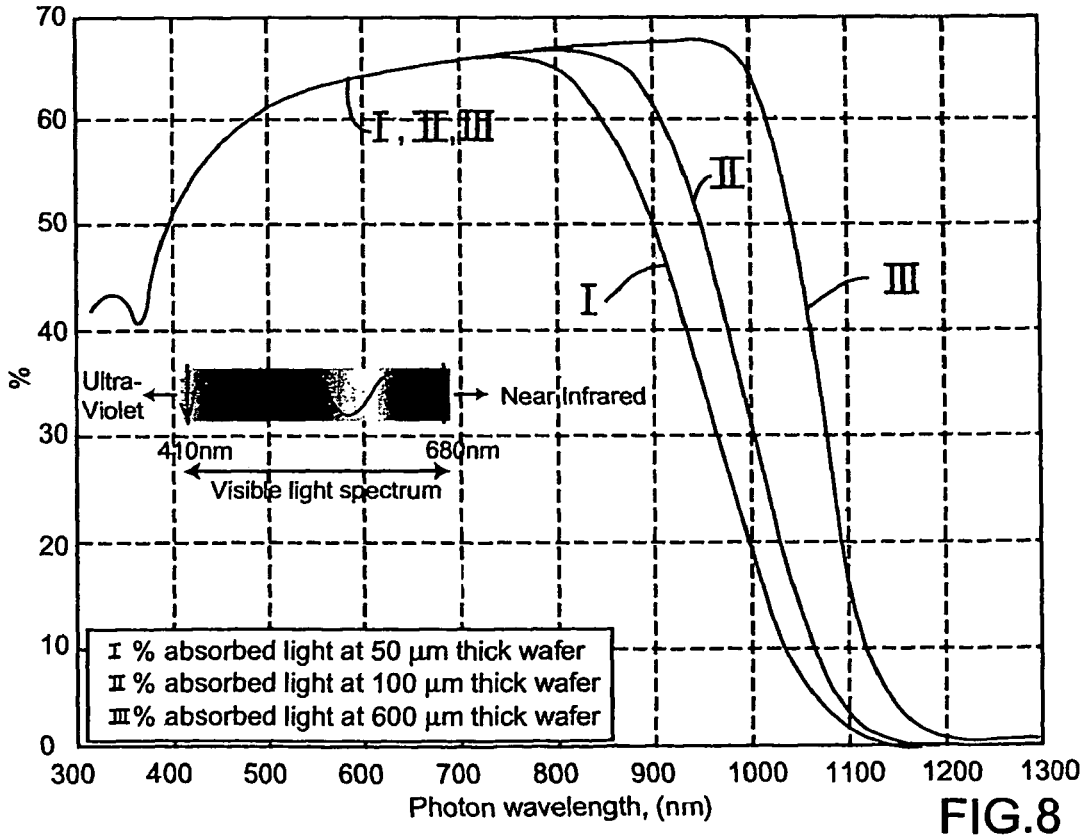
FIG. 8 illustrates the percentage of light absorbed by Si versus photon wavelength (in nanometers) for three different Si wafer thicknesses 50μ (I), 100μ (II) and 600μ (III).

Also in FIG. 8, which illustrates the percentage of light absorbed by Si versus photon wavelength (in nanometers) for three different Si wafer thicknesses 50μ (I), 100μ (II) and 600μ (III), a comparison of three different thicknesses wafers, i.e., 50 μm thick, 100 μm thick, and 150 μm thick, is depicted in terms of light power absorbed by the material, to illustrate the percentage of light absorbed by silicon versus photon wavelength (in nanometers).

The semiconductor complex relative permittivity containing electron-hole pairs is expressed as a sum of two, electron (e) and holes (h) dependant terms:

$$\epsilon_r^{Si} = \epsilon_u - \sum_{i=e,h} \frac{\overline{\omega}_{pi}^2}{(2\cdot\pi\cdot f)^2 + v_i^2} \cdot \left(1 + j\cdot\frac{v_i}{2\cdot\pi\cdot f}\right)$$

where $\overline{\omega}_{pi}^2=(N\cdot q^2/\in_0\cdot m_i)$ is the plasma angular frequency, $\in_u=11.8$ is the dark dielectric constant of silicon, vi is the collision angular frequency, $m_i$ is the effective mass of the carrier, q is the electronic charge and $\in_0$ is the permittivity of free space.

For computation reasons: $\in_0=8.854\cdot10^{-12}$ $F\cdot m^{-1}$, $v^e=4.53\cdot10^{12}$ $s^{-1}$, $v_h=7.71\cdot10^{12}$ $s^{-1}$, $m_e=0.259\cdot m_0$, $m_h=0.38\cdot m_0$, $m_0=9.107\cdot10^{-28}$ g is the free electronic mass and N is the number of carriers generated in the plasma.

The dielectric constant of a material is defined as a real and an imaginary part. The relation between the real and the imaginary part is what we call the tan(δ) of a material. This important material parameter is directly related with the losses of that material when an electromagnetic wave passes through it.

$$\varepsilon = \varepsilon' + j \cdot \varepsilon'' \quad \tan(\delta) = \frac{\varepsilon''}{\varepsilon'}$$

In the following Figures, a plot of the dielectric constant and the tan(δ) of silicon at different frequencies respectively 40 GHz and 250 GHz is depicted against the carrier concentration, N between $10^{10}$ and $10^{20}/cm^3$.

For example, it can be seen in FIG. 9 that at a carrier concentration of $10^{17}$ $cm^{-3}$, the real part of the dielectric constant of the silicon at 40 GHz is 85.6 and at $N=10^{18}$ $cm^{-3}$ is 750 where the silicon has a really high dielectric constant. At N above $10^{17}$ $cm^{-3}$, the real and imaginary part of the dielectric constant of the silicon increase with the same slope, so the tan(δ) becomes constant.

At no light condition, the amount of carriers in the silicon is around $10^{10}$ $cm^{-3}$ where the tan(δ) is around $10^{-4}$ at 40 GHz. But as the carrier concentration increases with light, the silicon becomes a very lossy material maintaining its dielectric constant quite stable. As it will be seen in the following passages of the description, it is interesting for phase shift to change the dielectric constant of silicon material to affect the propagation characteristics of electromagnetic waves, rather than changing the losses of the material which will attenuate the wave and which is interesting for the attenuator function of the device. So a certain amount of light per area is required.

In FIG. 10, it can be seen that at higher mm-wave frequencies, (250 GHz), the real part of the dielectric constant of the material behaves exactly as at 40 GHz, but the imaginary part is lower, but increases with light with the same slope, so in fact, the losses are lower at higher mm-wave frequencies.

From the understanding of the previous properties, it can be said that changes in the dielectric material properties of silicon by means of an optical source of variable intensity can be achieved. This property opens a new field of applications to design and manufacture a wide variety of components at mm-wave frequencies by means of photoillumination. We assume in our finite element calculations by means of Ansoft-HFSS that the plasma thickness remains constant while the plasma density varies in this thickness with intensity of applied light.

The main reason of this study is to design, manufacture and measure a phase shifter for rectangular waveguide technology. The tuneable phase shifter has to achieve a phase shift with high accuracy and as low losses as possible. A best mode is a tuneable shifter with a 360° phase shift. The main idea of this concept is placing a piece of silicon inside the rectangular waveguide and changing its dielectric properties by means of appropriate conditions of photoillumination. If a certain size piece of silicon is placed inside a rectangular waveguide and is illuminated, it changes the propagation characteristics of the waveguide and the transmission characteristics of the waveguide.

The illumination may be performed by means of a metallic grid in one of the walls of the waveguide so that it is transparent for light and "metallic" for mm-waves so that the characteristics of the rectangular guide do not change.

Also, a certain amount of light required to perform a change in the propagation properties of the waveguide with a silicon piece inside. In fact, it easy to check that as the wavelength increases, the amount of light per unit area will be lower, because the silicon piece needed to perform the change will be smaller. In fact, if we increase the frequency by a factor of 10, the amount of light per unit area required will decrease by a factor of 100.

For ease of manufacture and measurement reasons the design given as example was prepared in Ka band for WR-28 standard waveguide. The dimensions of this waveguide are a=7.1 mm and b=3.6 mm, and in FIG. 11 it can be seen the wavelength inside this waveguide against frequency. Also in FIG. 11, we can see the effects on the wavelength (in mm) inside a WR-28 waveguide of a change of its parameter a as 7.1 mm, 6.5 mm, 6 mm, 5.5 mm, and 5 mm.

The wavelength inside a rectangular waveguide is defined by:

$$\lambda_g = \frac{\lambda_0}{\sqrt{1 - \left(\frac{\lambda_0}{2a}\right)^2}}$$

where $\lambda_0$ is the free space wavelength and a is the longest dimension of a rectangular waveguide.

This formula means that if we change the (a) parameter in a rectangular waveguide we will change its wavelength and in fact the phase for a certain length of waveguide. So if we place a piece of silicon in one of the waveguide walls and we change its dielectric constant from 11.8 to above 100 in fact we will change the (a) dimension of the waveguide changing its inside wavelength for a certain frequency.

The amount of phase change will depend then of the thickness on the silicon piece, its position inside the waveguide, its length and the dielectric constant of the photoilluminated silicon that we will achieve. Special care must be taken to avoid losses in the waveguide if we try to achieve a big phase change in a short length and we push the waveguide near cut off because the return losses of the device will increase a lot.

Figure 12A:
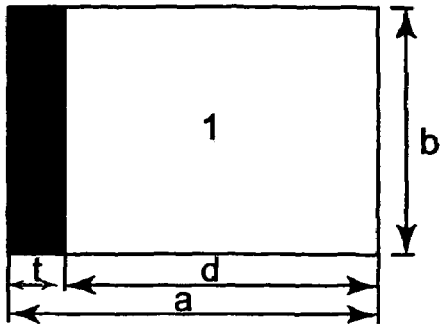
FIGS. 12*a* and 12*b* show an inhomogeneously filled waveguide with a dielectric piece of thickness t in a wall thereof and the fundamental mode $TE_{10}$ therein.
Figure 12B:
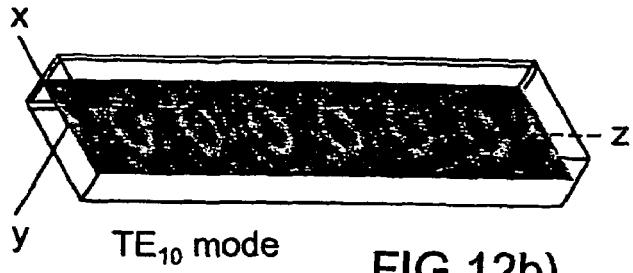

If we analyse a rectangular waveguide 1 with a piece of silicon in one of the walls, (see FIG. 12*a*), of dimensions a and b, and thickness of the piece of silicon as t, where a=d+t, we can conclude that the propagation is very similar to that of a normal rectangular waveguide. In fact, as can be seen in FIG. 12*b*, which shows axes x, y, and z, the fundamental mode is very similar to the $TE_{10}$ of normal rectangular waveguide [Field Theory of Guided Waves, Collin], this mode has the advantage that only a small amount of the field will travel inside the silicon insert, so the losses will be low, and the cutoff frequency of this type of waveguide is lower than in a normal rectangular waveguide, (also an advantage, besides we must be careful with other modes that can appear at the higher frequencies of the band).

Figure 13:
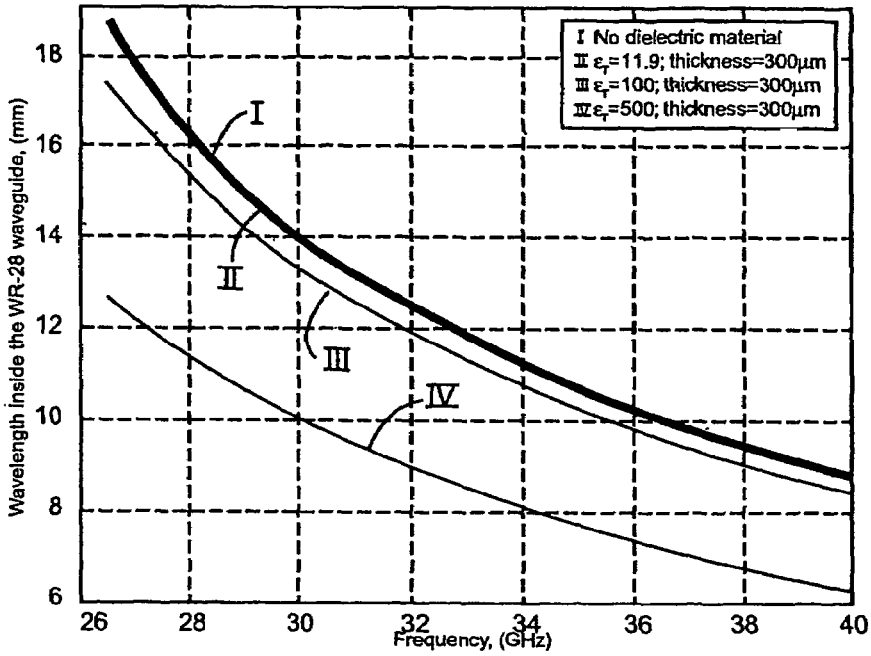
FIG. 13 shows curves of the wavelength (in millimeters) as a function of frequency (GHz) inside a WR-28 waveguide with a 300μ thick piece of Si in a wall thereof under different light conditions.

In FIG. 13 it can be seen the wavelength of a WR-28 waveguide with a 300 μm thick piece of silicon in the wall of the waveguide under dark and illuminated conditions, represented by curve I (no dielectric material), curve II ($\in_r$=11.9), curve III ($\in_r$=100), and curve IV ($\in_r$=500).

As shown in FIG. 13, the wavelength of a normal WR-28 waveguide and the same waveguide filled with a 300 μm thick silicon in the wall under dark condition is nearly the same. Upon illumination of the silicon, the dielectric constant changes inside it and produces a change in the wavelength and in fact in the phase. To achieve an efficient phase change in a short device, the change of the dielectric constant of the silicon by means of photoillumination must be high.

As an example, if we change the dielectric constant of the material from 11.9 to 500, we need a length of 40 mm of silicon to achieve a total 360 degrees phase change in the whole Ka band, but if we only reach a dielectric constant of 100 a length of nearly 300 mm of silicon is needed. So the device will be in the latter case not very practical if the aim is to obtain a 360° phase shift.

To reach a dielectric constant of 500 to allow an efficient and compact device over an area of 40×3.6 mm, means that, the carrier concentration must be above $10^{18}$, which is quite high. Such a high density plasma will not be reached with a normal light equipment and costly equipment will be needed.

Figure 14:
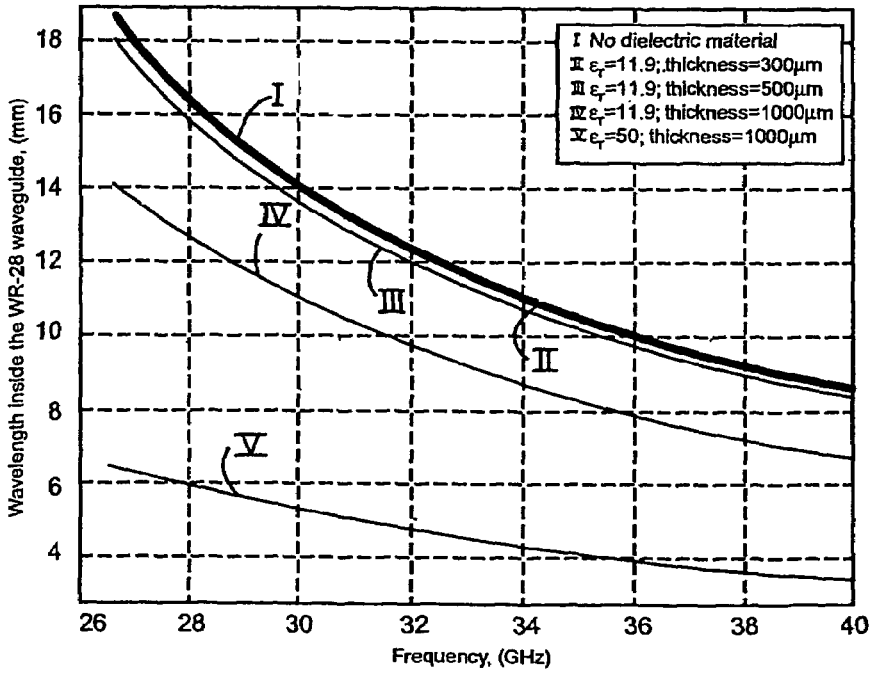
FIG. 14 shows curves of the wavelengths (in millimeters) as a function of frequency (GHz) for a WR-28 waveguide with a piece of Si in a wall thereof with different thicknesses 300μ (I), 500μ (II), 1000μ (III and IV), and two different light conditions for the thickness of 1000μ.

FIG. 14 shows curve I (no dielectric material), curve II ($\in_r$=11.9, thickness 300 μm), curve III ($\in_r$=11.9, thickness 500 μm), and curve IV ($\in_r$=11.9, thickness 1000 μm), and curve V ($\in_r$=50, thickness 1000 μm). It can be seen from FIG. 14, that if a thicker silicon piece of 1 mm thickness is used, a length of 15 mm silicon that changes its dielectric constant from 11.9 to 50 will suffer to achieve a 360° phase change in the whole Ka band. This means a carrier concentration around $5\cdot10^{16}$ which is easily obtainable.

If a piece of a dielectric material is placed inside a rectangular waveguide parallel to its dominant mode E field and spaced from an inside wall, simple finite-element simulation models can be solved to extract the modes of propagation inside that type of waveguide and its characteristics.

If we classify the modes of this type of waveguide for dark conditions, (FIGS. 15, 16*a*, 16*b*, which each show a waveguide model and mode), we can see that there are three main modes in propagation (WR-28 waveguide with 300 μm thick silicon piece 0.85 mm inside).

Figure 15:
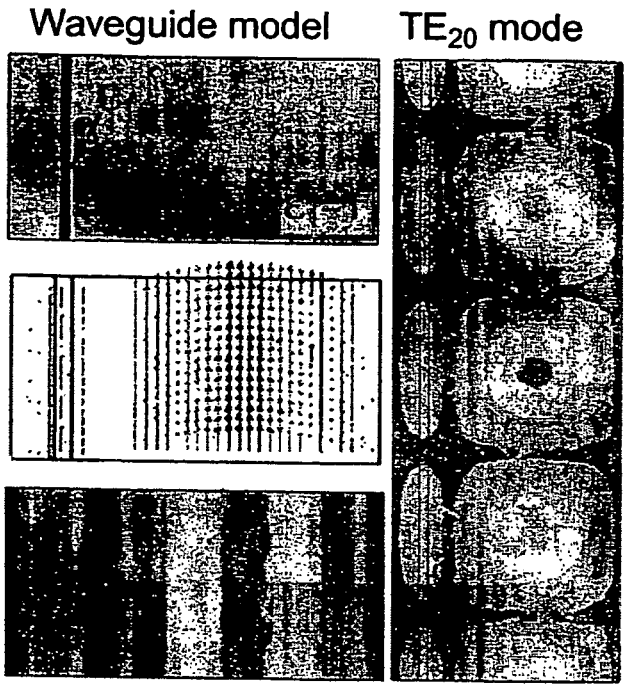
FIGS. 15, 16*a* and 16*b* show an inhomogeneously filled WR-28 waveguide with an inside dielectric piece spaced from a wall of the waveguide for resultant modes respectively $TE_{20}$ mode (FIG. 15), $TE_{10}$ mode (FIG. 16*a*) and $TM_{11}$ mode (FIG. 16*b*); these modes are not equal to the modes of a conventional rectangular waveguide.
Figure 16A:
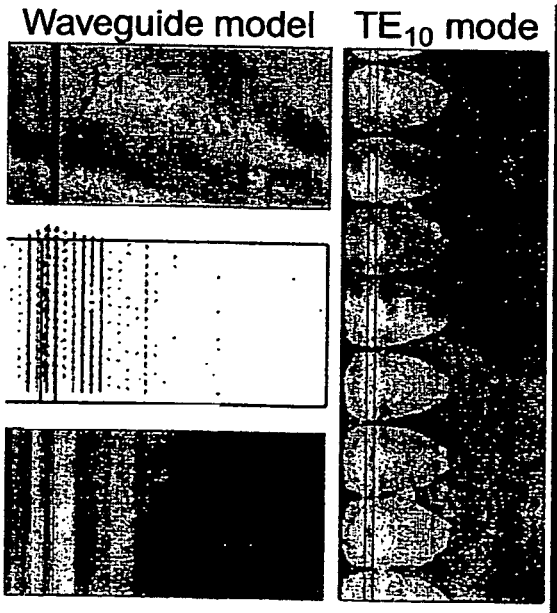

As shown in FIG. 15, the first mode in this type of waveguide, is a $TE_{20}$ mode of a first type with part of its field inside the dielectric and part of the field in the waveguide. The field intensity inside the dielectric is much lower (e.g. by a factor of 10 or more) than the field in the rest of the waveguide, so the losses are not high. Also this mode couples very well to the $TE_{10}$ of normal rectangular waveguide.

Figure 16B:
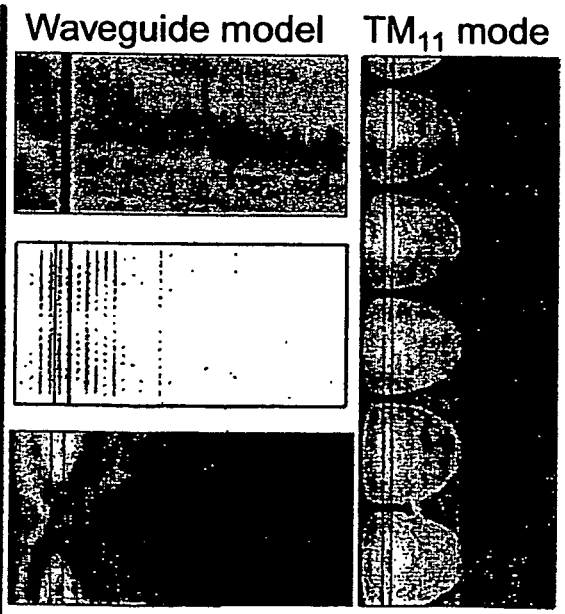

The second mode of this type of waveguide is a $TE_{10}$ mode of a second type that has its field concentrated inside the dielectric, (FIG. 16*a*), so it will be very lossy for phase shift, but very effective as attenuator. The same principles can be applied to the third mode of this type of waveguide, it is a $TM_{11}$ with its field concentrated inside the dielectric, (FIG. 16*b*).

Figure 17:
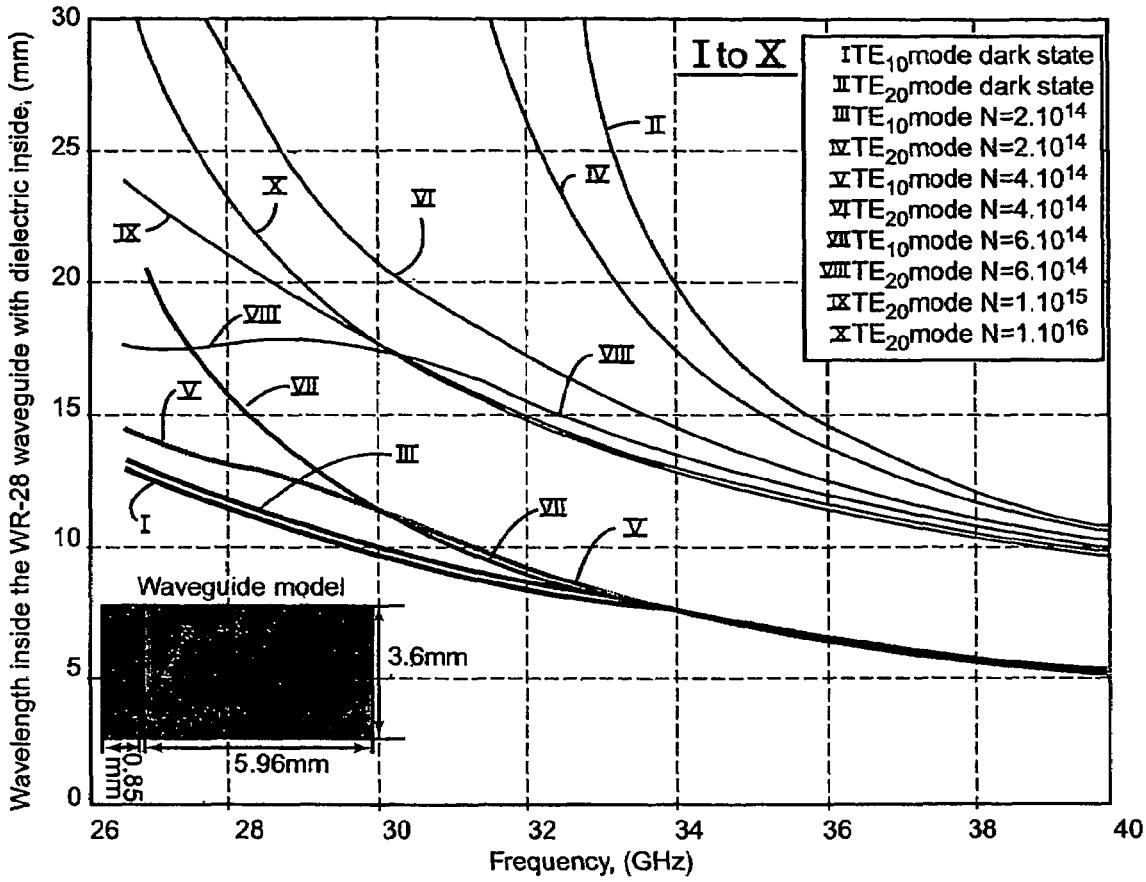
FIG. 17 represents the wavelength (in millimeters) of the propagative modes inside a WR-28 waveguide with a 300μ thick silicon dark pieces spaced 0.85 mm from a wall of a waveguide for $TE_{10}$ and $TE_{20}$ modes and different illumination levels corresponding to different densities of carriers inside the silicon piece.

In FIG. 17 we can see a particular example of this type of waveguide. Curves I-IX represent either $TE_{10}$ or $TE_{20}$ mode, and different carrier concentrations, ranging from a dark state to N=$1.10^{16}$. The wavelength of the two main modes is plotted against frequency for a WR-28 waveguide with a 300 μm thick silicon piece placed 0.85 mm inside the waveguide, $TM_{11}$ mode is not plotted. IGS coupling efficiency to a $TE_{10}$ of normal rectangular waveguide is very low, so that it is suitable as an attenuator, not for phase shifting.

From the example of FIG. 17, which shows a waveguide model, dark states, and different N carrier concentrations, we can see that the $TE_{20}$ mode (curves II, IV, VIII, IX, X), which seems to be the most beneficious mode reaches cut off very soon for dark silicon. But when the illumination over the silicon increases, its cut-off frequency becomes lower. $TE_{10}$ mode is in cut-off above a carrier concentration of $6\cdot10^{14}$ (curve VII), so when the illumination increases, this lossy mode is no longer present, losses are heavily reduced, and the only mode that survives is the $TE_{20}$ that, as the dielectric constant of the silicon increases, becomes more similar to the $TE_{10}$ of normal rectangular waveguide and its field inside the silicon lowers a lot, (so lowering the losses of the component). With different waveguide dimensions and/or thickness of the dielectric piece, the carrier concentration above which the $TE_{10}$ mode is in cut-off will be different, but this effect will be useable by adjusting the intensity of light to place this mode (or other modes of the same type) in a cut-off state.

So what is obtained with the example of FIG. 17 is:

- a change in the wavelength inside the waveguide from 13 mm ($TE_{10}$ mode) to more than 25 mm ($TE_{20}$ mode) at 26.5 GHz changing the amount of carriers from $10^{12}$ to $10^{15}$ in the silicon piece
- a change in wavelength at 35 GHz from 16 mm to 13 mm if we assume only $TE_{20}$ mode
- and a change in wavelength at 40 GHz from 11 mm to 9 mm assuming only $TE_{20}$ mode With this structure, a complete 360° phase shifter works in a frequency range from approximately 34 GHz to 40 GHz with a length of 44 mm and with not a huge amount of light ($10^{15}$ carriers per cubic centimeter).

At lower frequencies (less than 34 GHz) and in the dark state (no illumination), the travelling mode in the phase shifter is the $TE_{10}$ and when there is photoillumination the mode must change to the $TE_{20}$. The $TE_{10}$ of the phase shifter couples badly to the $TE_{10}$ of a normal waveguide and coupling losses are high in the two transitions. Besides the losses inherent to the power travelling inside the silicon for a certain length are high.

Figure 18:
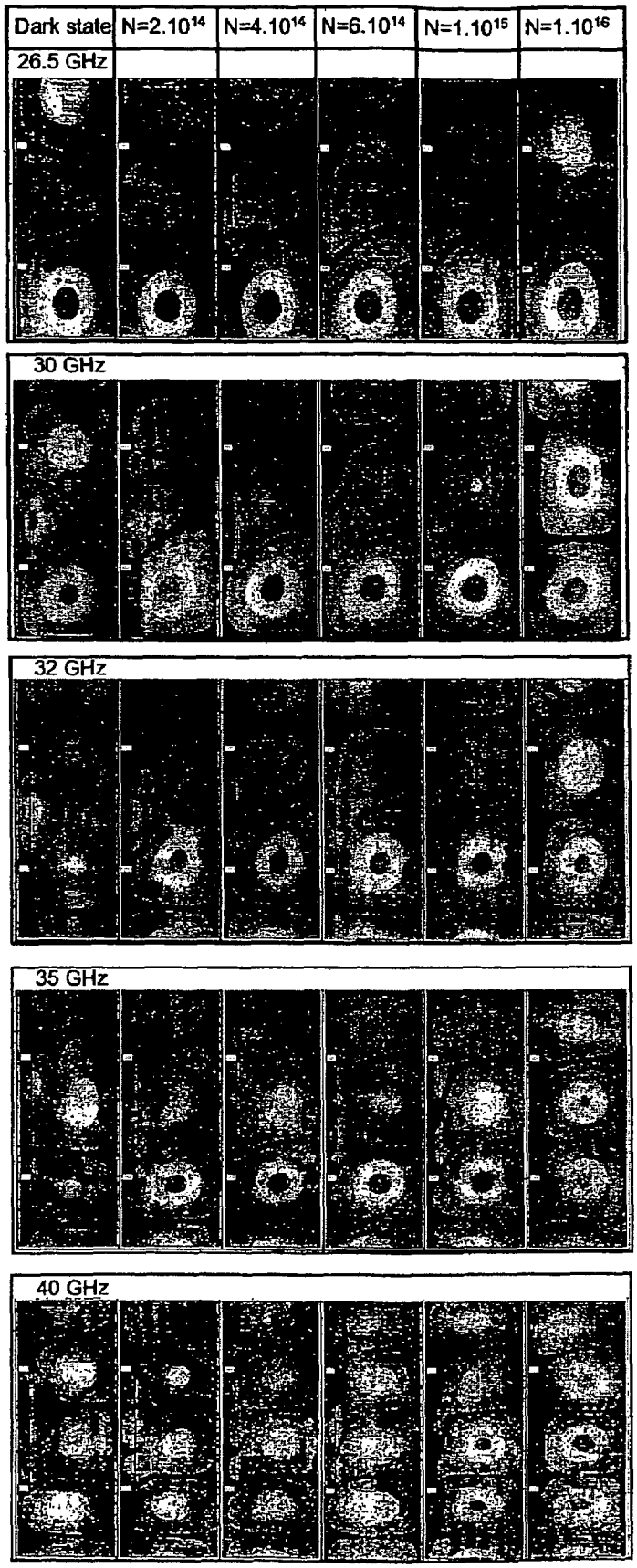
FIG. 18 illustrates propagation at different frequencies and under six different illumination states of a WR-28 waveguide with a piece of Si spaced 0.85 mm from a wall of the waveguide.

FIG. 18 illustrates propagation at five frequencies of 26.5 GHz, 30 GHz, 32 GHz, 35 GHz, and 40 GHz for a WR-28 waveguide with a piece of silicon spaced 0.85 mm from a wall of the waveguide. This Figure also illustrates the propagation for the dark state for each set of frequencies, and for five different carrier concentrations ranging from N=$2.10^{14}$ to N=$1.10^{16}$.

According to the invention, the piece of photo-responsive material may be illuminated at the Brewster angle (or less), so that internal reflection occurs and all of the light is absorbed and propagates along the length of the piece of photo-responsive material. This will reduce the amount of light required for a given phase shift or attenuation level.

The invention claimed is:

1. A tuneable phase shifter and/or attenuator comprising a waveguide having a channel defined by internal walls of the waveguide and a piece of photo-responsive material (18) disposed within the waveguide and having an outside surface directly along one of the internal walls of said channel, a light source disposed outside the waveguide to emit light through an aperture (30) of said internal wall to impinge on at least part of the outside surface of said piece of photo-responsive material (18).

2. The tuneable phase shifter and/or attenuator as in claim 1, wherein the photo-responsive material (18) is a photo-conductive material.

3. The tuneable phase shifter and/or attenuator of claim 2, wherein photo-conductive material is one of Si, GaAs or Ge.

4. A tuneable phase shifter and/or attenuator as in claim 1, wherein the illumination of the piece of photo-responsive material is carried out at an angle such that total internal reflection occurs.

5. The tuneable phase shifter and/or attenuator as in claim 1, wherein the at least part of the outside surface of the piece of photo-responsive material facing the aperture is covered with strips of reflective elements to avoid radiation inside the waveguide to be lost outside.

6. The tuneable phase shifter and/or attenuator as in claim 5, wherein said strips form a grid.

7. The tuneable phase shifter and/or attenuator as in claim 1 wherein the at least part of the outside surface of the piece of photo-responsive material facing the aperture is pacified by oxidation.

8. The tuneable phase shifter and/or attenuator as in claim 7, wherein the at least part of the outside surface of the piece of photo-responsive material facing the aperture has a coating of an epoxy resin.

9. The tuneable phase shifter and/or attenuator of claim of claim 1, wherein the light source is adjustable to generate in said piece of photo-responsive material (18) a carrier concentration between $10^{18}$ $cm^{-3}$ and $10^{21}$ $cm^{-3}$.

10. A tuneable phase shifter and/or attenuator comprising a waveguide having a channel defined by internal walls of the waveguide and a piece of photo-responsive material disposed within the waveguide and a light source to emit light to impinge on at least part of a surface of said piece of photo-responsive material, characterized in that the photo-responsive material is spaced from an internal wall of said channel and in that the light source is adjustable to generate in the piece of photo-responsive material a carrier concentration between $10^{12}$ $cm^{-3}$ and $10^{16}$ $cm^{-3}$, to modify the real and imaginary part of the dielectric constant of the photo-responsive material whereby at least one mode is generated that has part of a field of said at least one mode inside the piece of photo-responsive material and another part of the field in the waveguide whereby a phase shifter and/or attenuator that is dependant on the light illumination is generated over a frequency range.

11. A tuneable phase shifter and/or attenuator as in claim 10, wherein said at least one mode is of a second type that has the part of a field intensity inside the photo-responsive material that is high relative to the field in the channel outside the photo-responsive material.

12. A tuneable phase shifter and/or attenuator as in claim 11 wherein said at least one mode of the second type is $TE_{10}$ or $TE_{11}$.

13. A tuneable phase shifter and/or attenuator as in claim 12, wherein the intensity of the light source is adjustable to place at least one of said modes of the second type in a cut-off state.

14. A tuneable phase shifter and/or attenuator as in claim 10, wherein said carrier concentration is between $10^{14}$ $cm^{-3}$ and $10^{16}$ $cm^{-3}$.

15. A tuneable phase shifter and/or attenuator as in claim 10, wherein said at least one mode is of a first type that has a field intensity inside the photo-responsive material layer that is small relative to the field in the channel outside the photo-responsive material.

16. A tuneable phase shifter and/or attenuator as in claim 15, wherein said at least one mode of the first type is $TE_{20}$.

* * * * *